US008628261B2

(12) United States Patent
Taniguchi

(10) Patent No.: US 8,628,261 B2
(45) Date of Patent: Jan. 14, 2014

(54) SHEET CONVEYING APPARATUS

(75) Inventor: Hisashi Taniguchi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 617 days.

(21) Appl. No.: 12/753,385

(22) Filed: Apr. 2, 2010

(65) Prior Publication Data

US 2010/0254744 A1 Oct. 7, 2010

(30) Foreign Application Priority Data

Apr. 6, 2009 (JP) ..... 2009-092314

(51) Int. Cl.
*B41J 11/02* (2006.01)

(52) U.S. Cl.
USPC ..... 400/582; 347/104; 358/486

(58) Field of Classification Search
USPC ..... 400/582
See application file for complete search history.

(56) References Cited

U.S. PATENT DOCUMENTS

| | | | | |
|---|---|---|---|---|
| 3,951,251 | A * | 4/1976 | Zaccagnino, Jr. | 400/582 |
| 4,743,974 | A * | 5/1988 | Lockwood | 358/494 |
| 5,701,547 | A * | 12/1997 | Yamada et al. | 347/104 |
| 5,992,973 | A * | 11/1999 | Wen | 347/43 |
| 6,371,592 | B1 * | 4/2002 | Otsuka et al. | 347/19 |
| 6,599,042 | B2 | 7/2003 | Wolf | |
| 7,104,710 | B2 | 9/2006 | Otsuka | |
| 7,511,862 | B2 * | 3/2009 | Sano et al. | 358/474 |
| 7,548,353 | B2 * | 6/2009 | Kakutani | 358/486 |
| 7,609,423 | B2 * | 10/2009 | Sano et al. | 358/498 |
| 7,706,030 | B2 * | 4/2010 | Herloski et al. | 358/488 |
| 2006/0119899 | A1 * | 6/2006 | Kawai et al. | 358/484 |

FOREIGN PATENT DOCUMENTS

CN 1572688 A 2/2005

* cited by examiner

*Primary Examiner* — Jill Culler
(74) *Attorney, Agent, or Firm* — Canon U.S.A., Inc. IP Division

(57) ABSTRACT

An apparatus includes a platen including a supporting surface that supports a sheet that is conveyed, a sensor unit including an image sensor that takes an image of the sheet so as to detect the movement of the sheet. The sensor unit is embedded in the supporting surface and takes an image of a back side of the sheet, the sheet being supported on the supporting surface.

12 Claims, 11 Drawing Sheets

SHEET CONVEYING APPARATUS

BACKGROUND OF THE INVENTION

1. Field of the Invention

The present invention relates to a sheet conveying apparatus used in a printer.

2. Description of the Related Art

There has been an increasing demand for printers with high print quality and a demand for ever increasing precision. At the same time, there has been an increasing demand for cost reduction. Thus, both higher precision and cost reduction are expected for a printer. To address the situation, attempts have been made to detect the movement of a sheet being conveyed by taking an image of a surface of the sheet with an image sensor and performing image processing on the image, so as to detect the movement of the sheet with high precision and thereby convey the sheet under feedback control.

U.S. Pat. Nos. 7,104,710 and 6,599,042 disclose techniques related to the movement detection of the sheet. With the techniques, images of a surface of a sheet being moved are sequentially taken a plurality of times by an image sensor, the images are compared with each other by performing pattern matching, and the amount of the movement of the sheet is detected from the amount of difference between the images.

A sheet being conveyed may rise above a proper position and the distance between the image sensor and a surface of the sheet may change. Moreover, the distance between the image sensor and the surface of the sheet may change when the thickness of the sheet being used changes. If this phenomenon occurs, the size of an image taken by the image sensor is changed, so that the amount of the movement of the sheet may not be accurately detected. This can be prevented by using a telecentric lens or a lens having a focusing function as an imaging optical system. However, such an optical system is not suitable for reducing the cost and the size of the apparatus, because such an optical system is generally complicated and expensive.

When dust adheres to a surface of a lens of the imaging optical system or a surface of the image sensor, a clear image cannot be obtained, which may lead to erroneous detection. In particular, portions of ink drops ejected from the print head tend to float in an inkjet printer as ink mist, and the ink mist may adhere to the surface or a lens or an image sensor.

The present invention provides an improved apparatus in view of the above-described situation. In particular, the present invention provides an apparatus with which, by using image processing, the movement of a sheet can be reliably detected while preventing increase in cost. The present invention also provides an apparatus in which the detection accuracy does not decrease for a long time by preventing ink mist and dust, which float in the apparatus, from adhering to a sensor unit.

SUMMARY OF THE INVENTION

An apparatus according to an aspect of the invention includes a conveying mechanism that conveys a sheet; a platen including a supporting surface that supports the sheet at a processing position; and a sensor unit including an image sensor that takes an image of the sheet so as to detect movement information of the sheet, wherein the sensor unit is embedded in the supporting surface and takes an image of a back side of the sheet, the sheet being supported on the supporting surface.

Further features of the present invention will become apparent from the following description of exemplary embodiments with reference to the attached drawings.

DESCRIPTION OF THE EMBODIMENTS

Hereinafter, embodiments of the invention will be described with reference to the drawings. Components of the embodiments are only exemplary and do not limit the scope of the invention.

The invention can be widely applied to movement detection techniques that are used in a printer and other apparatuses in which movement of an object is to be detected with high precision. The invention can be applied to an apparatus that conveys an object so as to inspect, read, process, or mark the object with a processing unit of the apparatus. Examples of the apparatus include printers, scanners, and the like that are used in the manufacturing industry, the logistic services, and other industries.

Hereinafter, an inkjet printer will be described as an example. The printer according to an embodiment of the invention can be applied not only to a single function printer, but also to a multifunction printer having a copying function, a scanning function, and the like. Various methods of inkjet printing such as a method using an exothermic body, a method using a piezoelectric device, a method using an electrostatic element, and a method using a microelectromechanical system device can be used. The printing method is not limited to inkjet printing, and various methods such as an electrophotographic method and a thermal transfer method can be used. In this specification, the term "sheet" refers to a sheet-shaped or a plate-shaped object made of a material such as paper, plastic, film, glass, ceramic, or resin.

First Embodiment

Figure 1:
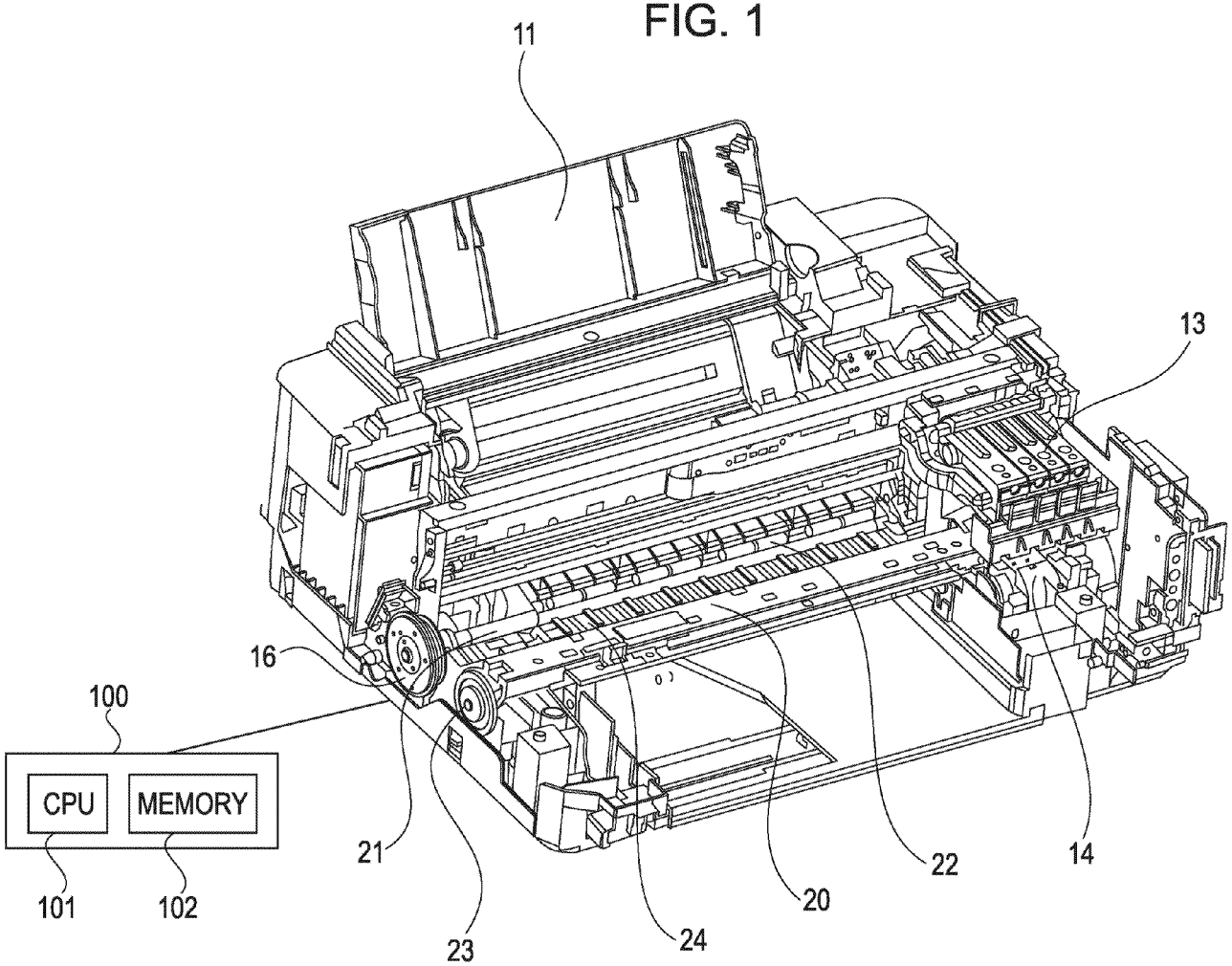
FIG. 1 is a perspective view illustrating the internal structure of a printer according to a first embodiment.

FIG. 1 is a perspective view of an inkjet printer according to a first embodiment. The inkjet printer includes a feeding unit 11, a conveying unit 20, a print processing unit 13, and a recovery mechanism 14. The inkjet printer further includes a controller 100 that controls the units included in the printer. The controller 100 corresponds to a control unit. The controller 100 includes a CPU 101, a memory 102, and various I/O interfaces. The controller 100, although schematically illustrated in FIG. 1, is disposed in the housing of the printer in reality.

The feeding unit 11 supplies a sheet to the printer. The sheet is fed to the conveying unit 20 one by one after being separated from a stack of sheets contained in the feeding unit 11. The conveying unit 20 conveys the sheet in the sub-scanning direction during printing. The sheet, which has been fed from the feeding unit 11, is nipped between a pair of rollers and conveyed in the sub-scanning direction. The pair of rollers include a conveying roller 21, which is rotated by a motor 26, and pinch rollers 22 rotated by the conveying roller by being urged toward the conveying roller 21. A platen 24 includes a supporting surface that supports the sheet from below while the sheet is being conveyed at the print position. When printing on the sheet has finished, the sheet is discharged to the outside of the housing by a discharge roller 23 and a spur roller 25. The discharge roller 23 rotates in time with the conveying roller 21, and the spur roller 25 is rotated by the discharge roller 23. The print processing unit 13 includes a carriage on which a print head and ink are disposed. The carriage reciprocates in the main scanning direction (a direction perpendicular to the sub-scanning direction). The carriage reciprocates along a guide rail by being driven by a drive mechanism that includes a carriage motor and a belt that transmits rotation of the carriage motor. A linear encoder is provided so as to detect the movement of the carriage in the main scanning direction. The apparatus of the first embodiment is a so-called serial printer. Printing is performed on the entire sheet while, in alternate sequence, the print head performs printing in time with the reciprocation of the carriage (main scanning) and the sheet is conveyed by a predetermined distance (sub-scanning). The recovery mechanism 14 is disposed at a position that faces the print head when the carriage is at the right end of the guide rail. The recovery mechanism 14 performs recovery operations on the print head such as wiping-off cleaning of the nozzle surface, removal of nozzle blockage by suction, and prevention of drying of the print head by capping.

Figure 2:
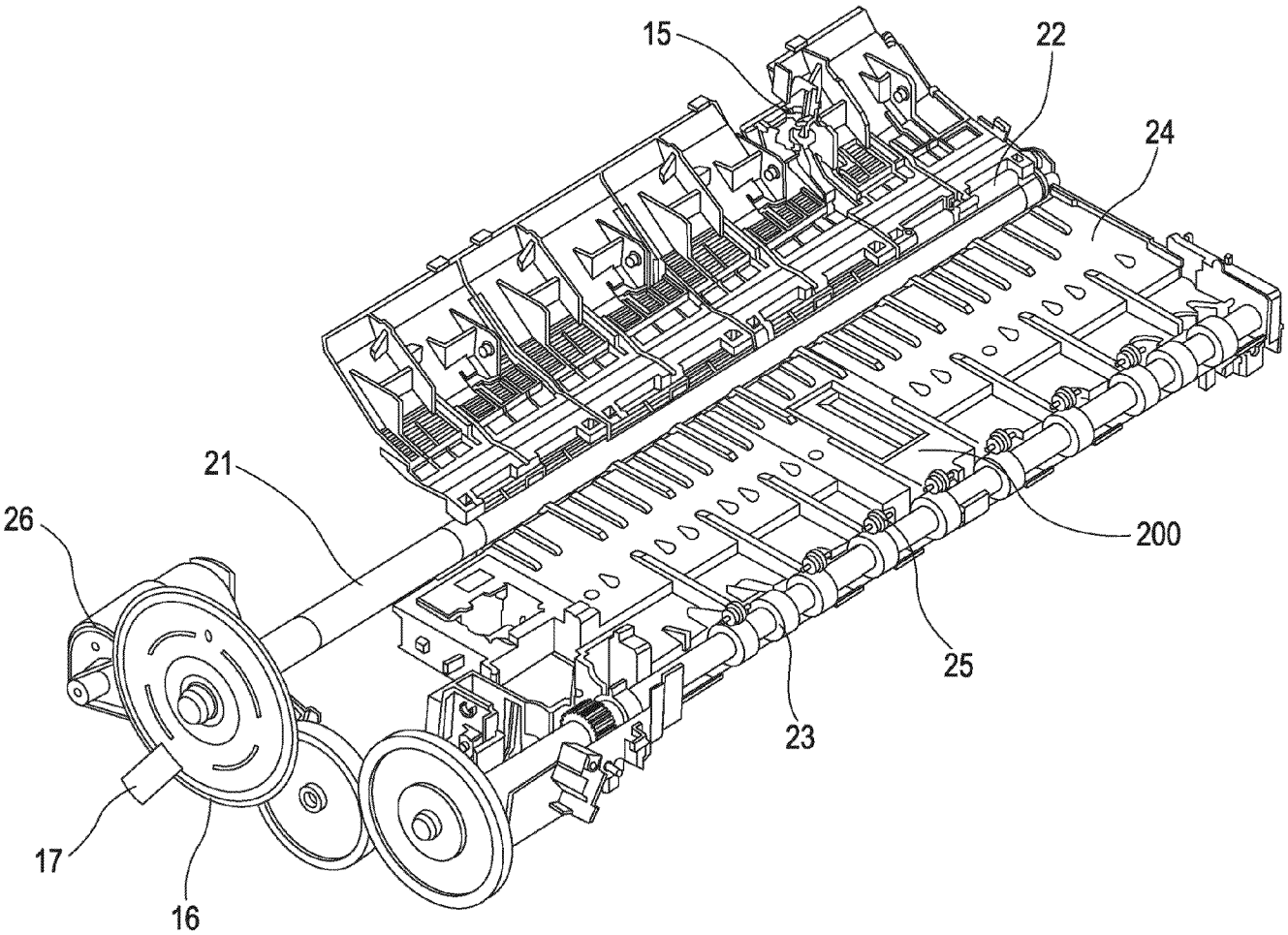
FIG. 2 is a perspective view of a conveying unit.

Referring to FIG. 2, the conveying unit 20 will be described in detail. A sheet detector 15 detects the leading end of the sheet that is fed from the feeding unit 11. The sheet, which is conveyed by being nipped between the pair of rollers including the conveying roller 21 and the pinch rollers 22, is supported on the supporting surface of the platen 24 at the print position. Thus, the position of the sheet S in the height direction at the print position (the distance between the surface of the sheet and the print head at the print position) can be precisely controlled. A sensor unit 200 is embedded in the supporting surface so as to detect the movement of the sheet by performing image processing as described below. An encoder is provided so as to detect rotation of the conveying roller 21, which is one of the pair of rollers. The encoder is a rotary encoder (rotation angle sensor) that includes a code wheel 16 and a reader 17. The code wheel 16, which is coaxial with the shaft of the conveying roller 21, includes a large number of slits along the circumference thereof. The reader 17 detects the slits in the code wheel 16. The reader 17 is a photo-interrupter that optically reads a code. The encoder obtains a detection signal (pulse signal) that corresponds to the rotation angle of the conveying roller 21. On the basis of the detection signal, the controller 100 performs feedback control of driving of the motor 26.

Figure 3:
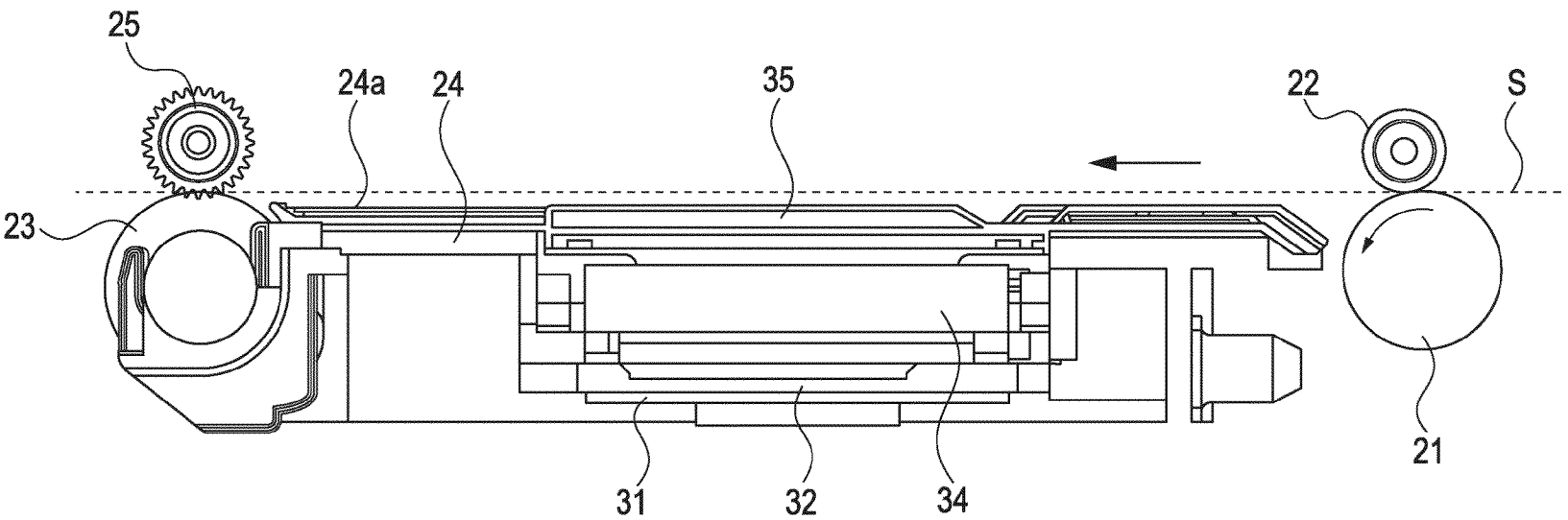
FIG. 3 is a cross-sectional view of the conveying unit.
Figure 4:
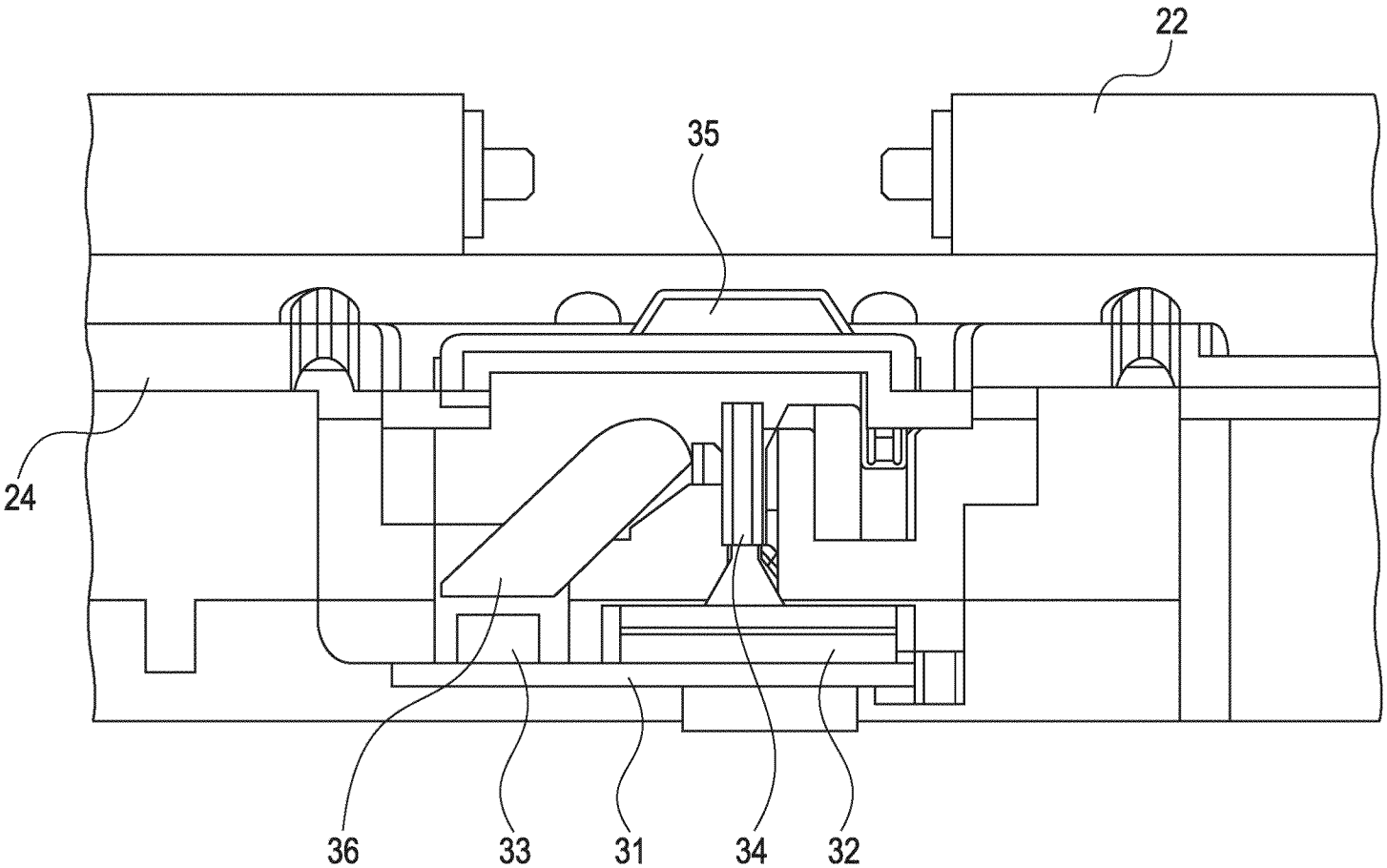
FIG. 4 is a longitudinal sectional view of the conveying unit.
Figure 5:
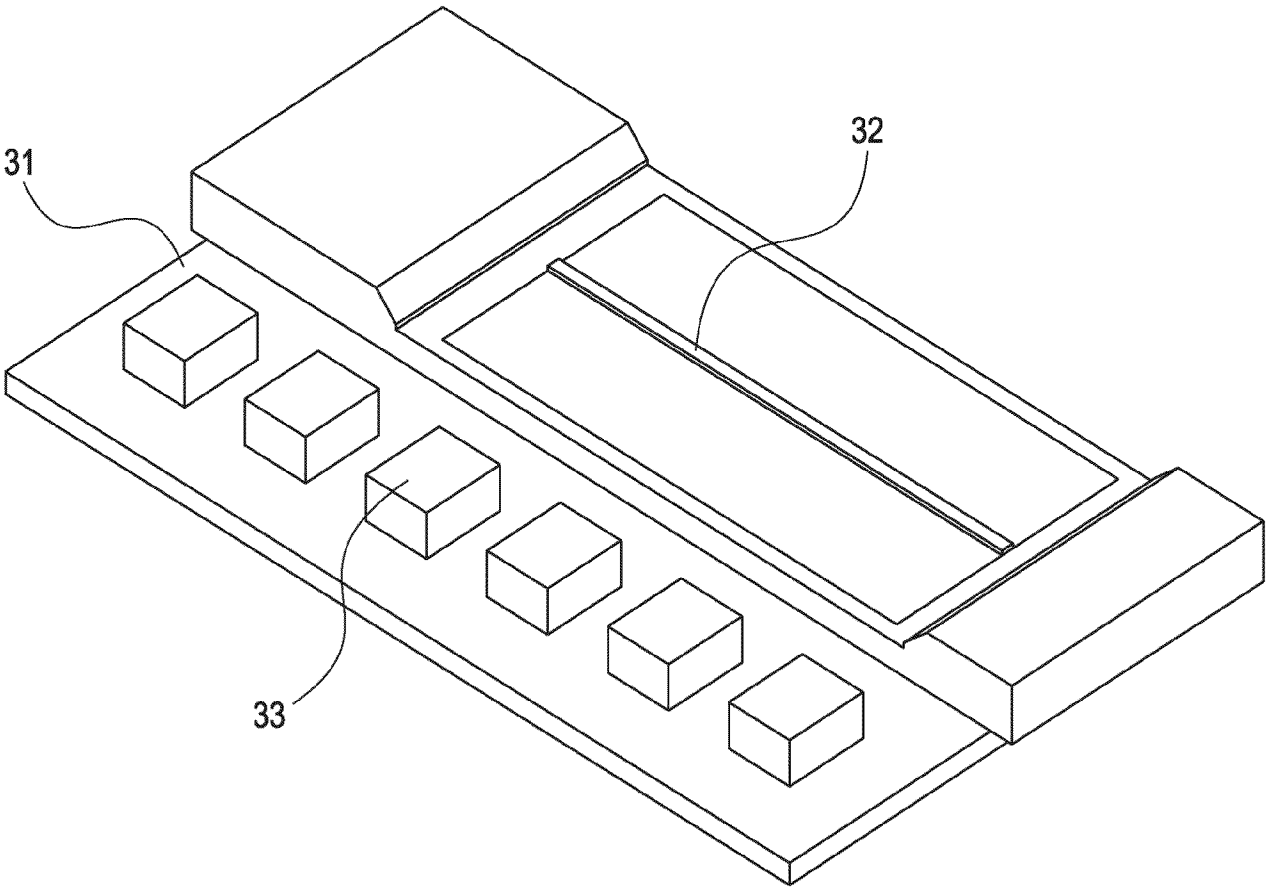
FIG. 5 is a perspective view of a sensor unit.

The sensor unit 200 will be described in detail. FIG. 3 is a cross-sectional view, and FIG. 4 is a partial longitudinal sectional view of the sensor unit 200 of the conveying unit 20. FIG. 5 is a perspective view illustrating the main structure of the sensor unit 200. In the first embodiment, the sensor unit 200 is embedded in a supporting surface 24*a* of the platen 24 so as to take an image of the sheet from the back side of the sheet, the sheet being supported on the supporting surface 24*a*.

The sensor unit 200 includes a photodetector and an illumination unit. The photodetector includes an image sensor 32, which corresponds to an image pickup device, and a rod lens array 34, which corresponds to an image-forming optical system. The illumination unit includes light-emitting elements 33, which correspond to a light source, and a light guide 36, which corresponds to an illumination optical system. The image sensor 32 and the light-emitting elements 33 are mounted on a sensor substrate 31 at a lower part of the sensor unit 200. A sensor cover 35 made of a transparent material is attached to an upper part of the sensor unit 200 opposite the sensor substrate 31. The sensor unit 200 illuminates and takes an image of the back side of the sheet S through the sensor cover 35.

A through-hole, for embedding the sensor unit 200 therein, is formed in the platen 24 at a position near the center of the platen 24 with respect to the main scanning direction (see FIG. 2) and directly below the print head with respect to the sub-scanning direction. The sensor substrate 31 is directly fixed to the lower surface of the platen 24 by thermal caulking so as to block the through-hole. The rod lens array 34, which is included in the photodetector, is disposed directly above the image sensor 32 that is mounted on the sensor substrate 31 (on the print head side). The rod lens array 34 is directly fixed to the platen 24 with an adhesive. The sensor cover 35 is disposed above the rod lens array 34. The sensor cover 35 prevents ink mist and foreign substances from entering the sensor unit 200 from the print head side. When the sheet is supported on the platen 24, components of the sensor unit 200 are disposed in a closed space surrounded by the sensor cover 35 from above and by the sensor substrate 31 from below. Therefore, foreign substances are prevented from adhering to the inside of the sensor unit 200. The sensor cover 35 is not limited to a plate-shaped member made of a transparent material. The sensor cover 35 may be an opaque plate-shaped member in which a through-hole (slit) is formed at a position through which light passes. The light guide 36, which is included in the illumination unit, guides light from the light-emitting elements 33, which are mounted on the sensor substrate 31, at a predetermined angle toward a surface of the sheet of which an image is to be taken. As with the rod lens array 34, the light guide 36 is directly fixed to the platen 24 with an adhesive, so that a position of the sheet can be illuminated with high precision.

As illustrated in FIG. 5, the image sensor 32 and the light-emitting elements 33 are mounted on a surface of the sensor substrate 31. The image sensor 32 is a CCD array sensor or a CMOS array sensor. The image sensor 32 includes sensitive elements arranged in a matrix of, for example, 512 pixels (sub-scanning direction)×12 pixels (main scanning direction). The number of pixels and the aspect ratio in the sub-scanning and main scanning directions are not limited to this, and may be appropriately designed. The light-emitting elements 33 are light sources such as LEDs, OLEDs, or semiconductor lasers. The light-emitting elements 33 are arranged in a longitudinal direction of the image sensor 32 so as to illuminate the imaging area of the image sensor 32 (having a narrow shape) with a uniform intensity.

An analog front-end circuit is mounted on the sensor substrate 31 so as to perform A/D conversion on the signal of the image sensor 32. The sensor substrate 31 has a connector to which a cable is connected. Through the cable, the sensor unit 200 sends or receives, to or from the outside, signals such as a power source signal, a control signal for controlling the illumination unit, and an output signal from the analog front-end circuit. The sensor unit 200 is electrically connected to the controller 100 through the cable, and the controller 100 controls the operation of the sensor unit and processes the output signal.

A method of detecting movement information of the sheet (the amount of movement or the movement speed) by performing image processing on the basis of image data obtained by the image sensor 32 will be described. The image sensor 32 obtains image data by taking, sequentially at predetermined timings, images of a surface state (such as fiber pattern of paper) of the sheet that is illuminated by the illumination unit. The predetermined timings are, for example, the timings before and after the sheet is conveyed by one line. The image signal obtained by the image sensor 32 is supplied to the controller 100. On the basis of the image data sequentially obtained at different timings, the controller 100 calculates the amount of the movement of the sheet by performing image processing including correlation calculation. In each step of successive sheet feeding, an image obtained before the sheet is moved will be referred to as first image data, and an image obtained after the sheet is moved will be referred to as second image data. A rectangular correlation window is set in a limited part of the first image data. Image data corresponding to the correlation window will be referred to as a template, and the position of the correlation window in the image data will be referred to as a template position. Pattern matching using correlation calculation is performed by using the template of a correlation window, which is set in the first image data obtained at a certain timing (before the sheet is moved), and the second image data sequentially obtained at another timing (after the sheet is moved). By performing pattern matching, the position of a template in the second image data that corresponds to the template in the first image data is detected. On the basis of the template positions in the first and second image data, the difference in these positions in the sheet conveying direction is calculated, and the amount of the movement of the sheet during the time when the first image data was obtained and the time when the second image data was obtained can be calculated. Pattern matching is a method of detecting the position of an image that has a specific pattern in image data by calculating the correlation between the image data. Area-based matching (window matching) is used as the method of correlation calculation. To be specific, a known algorithm, such as the sum of absolute difference (SAD) method, the sum of squared difference (SSD) method, the normalized correlation coefficient (NCC) method, or the phase-only correlation (POC) method, can be used. A position may be detected with sub-pixel precision by performing interpolation, such as parabola fitting, on the calculated correlation value.

Besides the pattern matching method, a known method of obtaining movement information for image processing may be used. Examples of such a method includes a method of checking correspondences for each frequency by performing Fourier transformation on a plurality of images, and a method of obtaining the amount of difference in the positions by extracting only the parts of images in which the values of the pixels of the image are peak values. The movement information that is calculated is not limited to the amount of movement. The speed of the movement, which is the amount of movement per unit time, and the acceleration of the movement, which is the rate of change in the speed, can be calculated.

Figure 6:
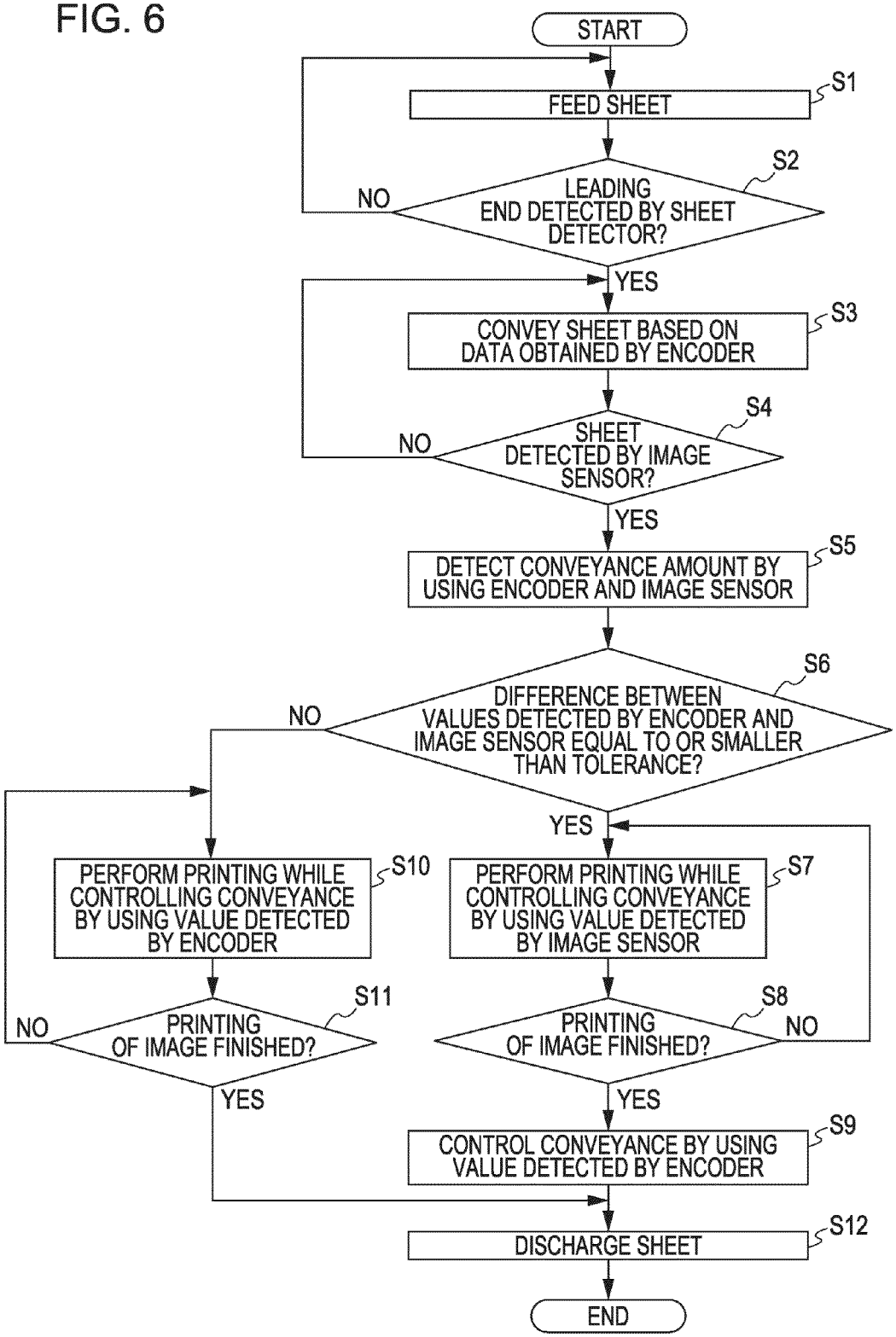
FIG. 6 is a flowchart illustrating the operation sequence of an apparatus.

Referring to the flowchart of FIG. 6, the operation sequence of the printer will be described. In step S1, a print start command starts feeding of a sheet. In step S2, whether the sheet detector 15 has detected the leading end of the sheet is determined. Feeding of the sheet is continued until the leading end of the sheet is detected (YES in step S2). When the sheet has correctly reached the conveying unit 20, the conveying roller 21 starts conveying the sheet. In step S3, the sheet is conveyed while feedback control of the conveying roller 21 is performed on the basis of the rotation angle of the conveying roller 21 detected by the rotary encoder. Whether the sheet has reached the imaging area of the sensor unit 200 can be detected by an image taken by the image sensor 32. In step S4, the image sensor 32 detects whether the sheet is present. If the sheet is detected (YES in step S4), the operation proceeds to step S5. In step S5, both the rotary encoder and the image sensor 32 detect conveyance information of the sheet, and detected values obtained by the rotary encoder and the image sensor 32 are stored in the memory of the controller 100. The movement information is detected by performing image processing with the image sensor 32 as described above.

In step S6, the amount of difference is calculated by comparing the detected values stored in the memory with each other, and whether the amount of difference is equal to or smaller than a tolerance (YES) or not (NO) is determined. If the determination is "YES" in step S6, the operation proceeds to step S7. If the determination is "NO" in step S6, the operation proceeds to step S10. In step S7, printing is performed while performing conveyance control of the sheet at least on the basis of the detected value obtained by the image sensor 32. The conveyance control can be performed by using detected values obtained by the image sensor 32 and the encoder. In step S8, the operation of step S7 is repeated until it is determined that printing of an image on the sheet has finished (YES). In step S9, conveyance control of the sheet is performed by using only the detected value obtained by the encoder. In step S12, the sheet is discharged, and the printing operation finishes.

If the operation proceeds to step S10 from step S6, printing is performed while performing conveyance control of the sheet by using only the detected value obtained by the encoder. In this case, the detected value obtained by the image sensor 32 is not used because the detected value obtained by the image sensor 32 is not reliable if it is determined in step S6 that these two detected values substantially differ from each other. The detected value obtained by the image sensor 32 is not reliable when, for example, matching pattern cannot be obtained because the sheet is very smooth and contrast of the images is low. Thus, the conveyance control is performed by using only the detected value obtained by the encoder, which has a certain degree of precision. In step S11, the operation of step S10 is repeated until it is determined that printing of an image on the sheet has finished (YES). After the image-forming has finished, the operation proceeds to step S12, and the printing operation finishes after the sheet is discharged.

Second Embodiment

In the first embodiment, the conveying mechanism that conveys the sheet is a pair of rollers that nip the sheet therebetween. In contrast, the second embodiment includes a conveyer belt that is looped over a plurality of rollers, and the conveyer belt moves while holding the sheet thereon. That is, the conveyer belt and the sheet contact each other, and the conveyer belt conveys the sheet. Other components, such as the feeding unit, the print processing unit, the recovery mechanism, the controller, and the housing are similar to those of the first embodiment. Therefore, description of these components will be omitted.

Figure 7:
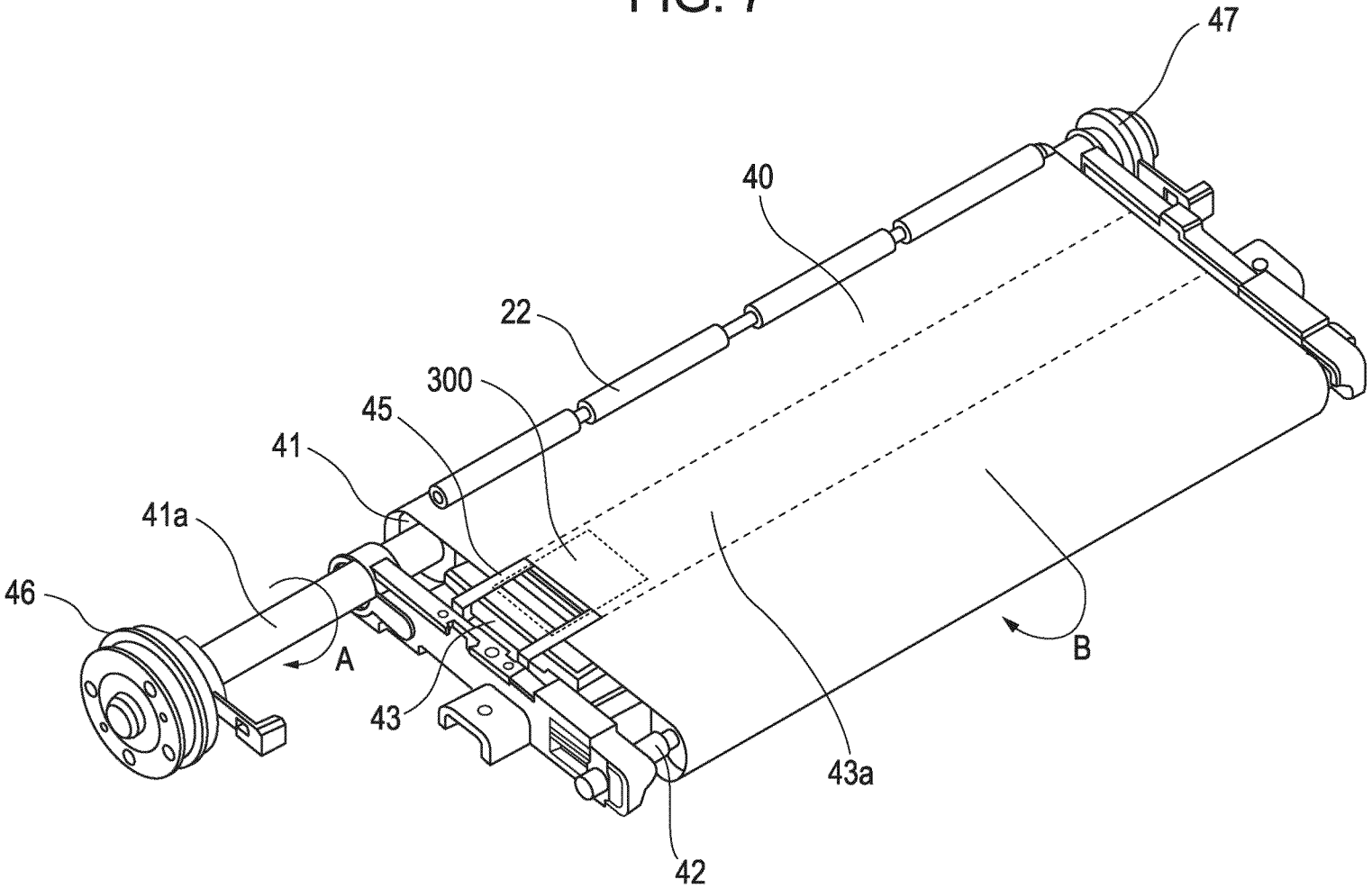
FIG. 7 is a perspective view of a conveying unit of a printer according to a second embodiment.

FIG. 7 is a perspective view of a conveying unit of an inkjet printer according to the second embodiment. FIG. 3 is a cross-sectional view of the conveying unit. A conveyer belt 40 is looped over a driving roller 41 and a driven roller 42 like a caterpillar. During printing, the driving force of the motor is transmitted through a driving mechanism 46 to a shaft 41*a* of the driving roller 41, so that the shaft 41*a* rotates in the direction indicated by an arrow A in FIG. 7. When the driving roller 41 rotates, the conveyer belt 40 and the driven roller 42 are rotated in a direction indicated by an arrow B. The driven roller 42 is urged by an elastic member in the downstream direction (a direction away from the driving roller 41). Thus, the conveyer belt 40 is looped over the driving roller 41 and the driven roller 42 with a predetermined tension.

A platen 43 is disposed at a position between the driving roller 41 and the driven roller 42 and between the upper part and the lower part of the conveyer belt 40 so as to face the print head. The platen 43 is supported by the frame of the apparatus at both sides thereof. The platen 43 extends though a space surrounded by the conveyer belt 40. The upper surface of the platen 43 includes a supporting surface 43*a* that supports the back side (the inner side) of the conveyer belt 40 from below (indicated by a dotted line in FIG. 7, because the supporting surface 43*a* is under the conveyer belt 40). The conveyer belt 40 is pressed against the supporting surface 43*a*, so that the position of the conveyer belt 40 is determined with respect to the height direction at the print position. Thus, while the sheet S is being conveyed on the conveyer belt 40, the position of the sheet S in the height direction (the distance between a surface of the sheet S and the print head) is correctly controlled. A sensor unit 300 is embedded in the supporting surface 43*a*. The sensor unit 300 detects the movement of the conveyer belt 40 by performing image processing as described below. The sensor unit 300 is disposed at a position at an end of the supporting surface 43*a* of the platen 43 with respect to the main scanning direction and directly below the print head with respect to the sub-scanning direction (indicated by a dotted line in FIG. 7).

The pinch rollers 22 are urged to the conveyer belt 40 at a position facing the driving roller 41 with the conveyer belt 40 therebetween. The pinch rollers 22 are rotated by the conveyer belt 40. The pinch rollers 22 serve to smoothly feed the sheet S onto the conveyer belt 40. The surface of the conveyer belt 40 is charged by a charging mechanism, so that the conveyer belt 40 applies an electrostatic attraction force to the sheet S placed thereon. The electrostatic attraction prevents the sheet S from slipping on the conveyer belt 40, so that unexpected misalignment between the sheet S and the conveyer belt 40 does not occur. An encoder 47 detects rotation of the driving roller 41. As with the case of FIG. 2, the encoder 47 is a rotary encoder (rotation angle sensor) including a code wheel that is coaxial with the shaft 41*a* of the driving roller 41 and a reader that detects a large number of slits formed in the code wheel along the circumference of the code wheel. The encoder obtains a detection signal (pulse signal) that represents a rotation angle of the driving roller 41. On the basis of the detection signal, the controller performs feedback control of the motor that rotates the driving roller 41.

Figure 8:
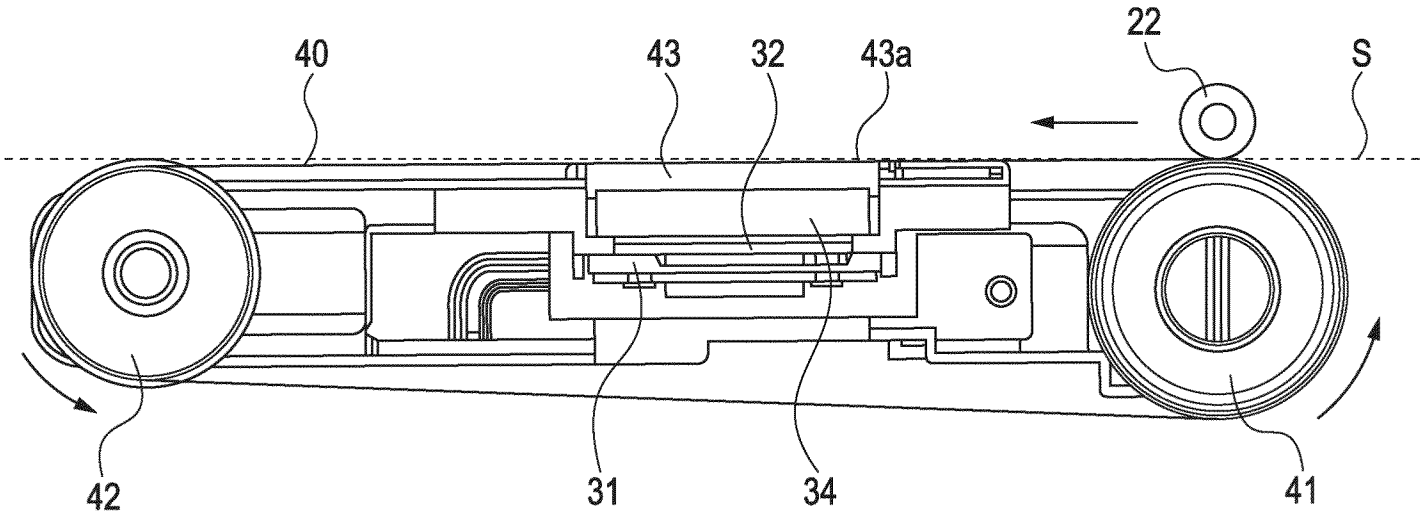
FIG. 8 is a cross-sectional view of the conveying unit.
Figure 9:
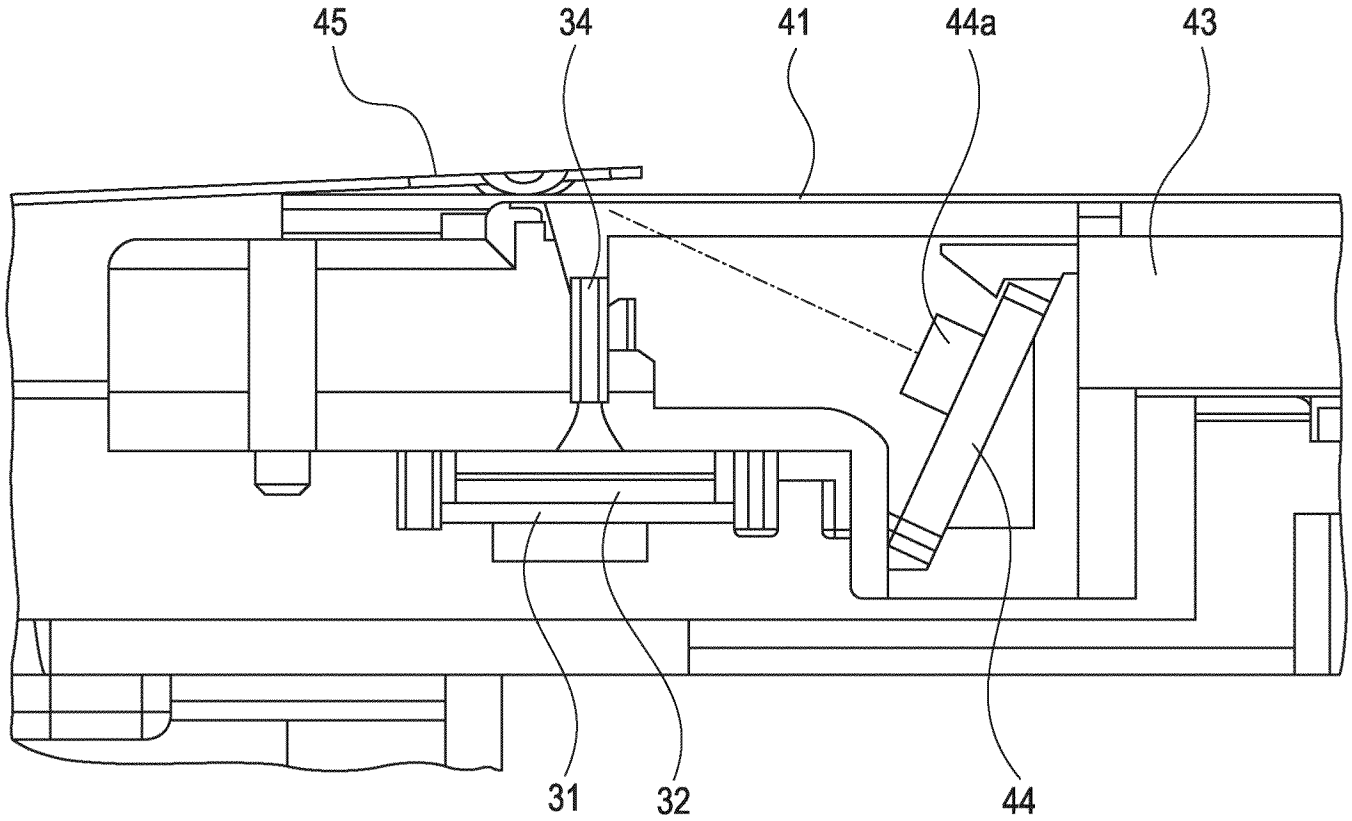
FIG. 9 is a longitudinal sectional view of the conveying unit.

The sensor unit 300 will be described in detail. FIG. 8 is a cross-sectional view of the sensor unit 300 of the conveying unit, and FIG. 9 is a partial longitudinal sectional view of the sensor unit 300. In the second embodiment, the sensor unit 300 is embedded in the supporting surface 43*a* of the platen 43. The sensor unit 300 takes an image of the conveyer belt 40 from the back side of the conveyer belt, the conveyer belt 40 being supported on the supporting surface 43*a*. In the first embodiment, the movement of the sheet is detected. In the second embodiment, the movement of the conveyer belt 40 is detected so as to detect the movement of the sheet. Because the sheet S closely contacts the conveyer belt 40 owing to electrostatic attraction as described above, the sheet S is not displaced on the conveyer belt 40, whereby the movement of the sheet can be correctly detected by detecting the movement of the conveyer belt 40. The method of image processing for detecting movement information on the basis of image data obtained by the image sensor is similar to that of the first embodiment. Therefore, description of the method is omitted.

The sensor unit 300 includes a photodetector and an illumination unit. The photodetector includes the image sensor 32, which corresponds to an image pickup device, and the rod lens array 34, which corresponds to an image-forming optical system. The structure, the shape, and the function of the image sensor are similar to those of the first embodiment. The illumination unit includes a light-source substrate 44 on which light-emitting elements 44*a*, such as LEDs, OLEDs, or semiconductor lasers, are mounted. The light-source substrate 44 is fixed to the platen 43 with an adhesive. The light-source substrate 44 illuminates the conveyer belt 40 from the back side of the conveyer belt 40 at a predetermined irradiation angle. The light-emitting elements 44*a* are arranged in the longitudinal direction of the image sensor 32 so as to uniformly irradiate the imaging area of the image sensor 32 that extends in the longitudinal direction. In the second embodiment, the light source substrate 44 and the sensor substrate 31 are different from each other, and are independently fixed to the platen 43. However, as with the first embodiment, the light emitting devices may be disposed on the sensor substrate 31. In the first and second embodiments, an unarrayed lens may be used instead of the rod lens array 34, and a module including the image sensor 32 and the image-forming optical system may be used. The imaging-forming optical system may be omitted by disposing the image sensor 32 at a position very close to the image pickup surface.

Figure 10:
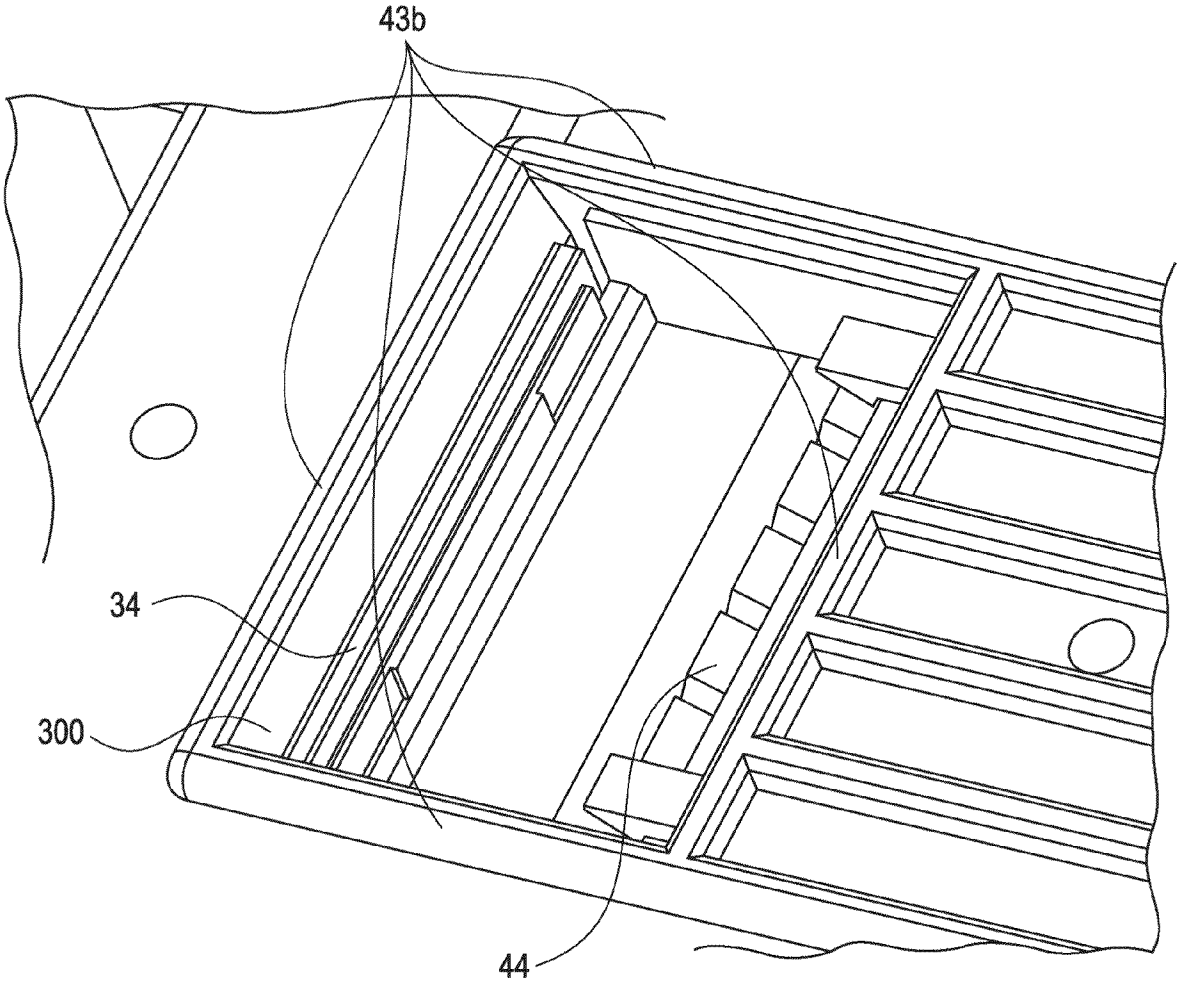
FIG. 10 is a partial enlarged sectional view of a supporting surface of a platen.

FIG. 10 is an enlarged view of the supporting surface 43*a* of the platen in the vicinity of the sensor unit 300. The sensor unit 300 is surrounded by a platen rib 43*b*. The platen rib 43*b* protrudes from the supporting surface and contacts the conveyer belt 40. In this state, components of the sensor unit 300 are disposed in a closed space that is surrounded by the conveyer belt from above and by the sensor substrate 31 from below. Thus, foreign substances are effectively prevented from adhering to the inside of the sensor unit 300.

A part of a surface of the conveyer belt 40 (the back side) in the vicinity of the imaging area of the image sensor 32 is roughened so that microscopic protrusions and recesses are formed on the surface. The other part of the surface of the conveyer belt 40 is made smoother (has a smaller surface roughness) so as to increase the effect of an electrostatic attraction force. When the sensor unit 300 illuminates the microscopic protrusions and recesses on the conveyer belt 40, shade appears in accordance with the protrusions and recesses of the surface. A high contrast image data is obtained by taking the image of the shade. Thus, image processing can be easily performed and movement detection can be performed more accurately and reliably. Alternatively, a large number of marks may be engraved in the surface (the back side) of the conveyer belt 40 in the vicinity of the imaging area of the image sensor 32 at irregular distances in the sheet conveying direction (the direction in which the conveyer belt moves).

A pressing member 45 presses the conveyer belt 40 against the supporting surface of the platen 43 at a position above the sensor unit 300. The pressing member 45 is disposed at a position outside a region in which the sheet is supported with respect to the main scanning direction so that the pressing member 45 does not contact the sheet. The pressing member 45 prevents the conveyer belt 40 from rising above the supporting surface of the platen 43 while the sheet is being conveyed. Thus, an image of the conveyer belt 40 can be appropriately taken even if the depth of focus of the rod lens array 34 of the photodetector is small.

Figure 11:
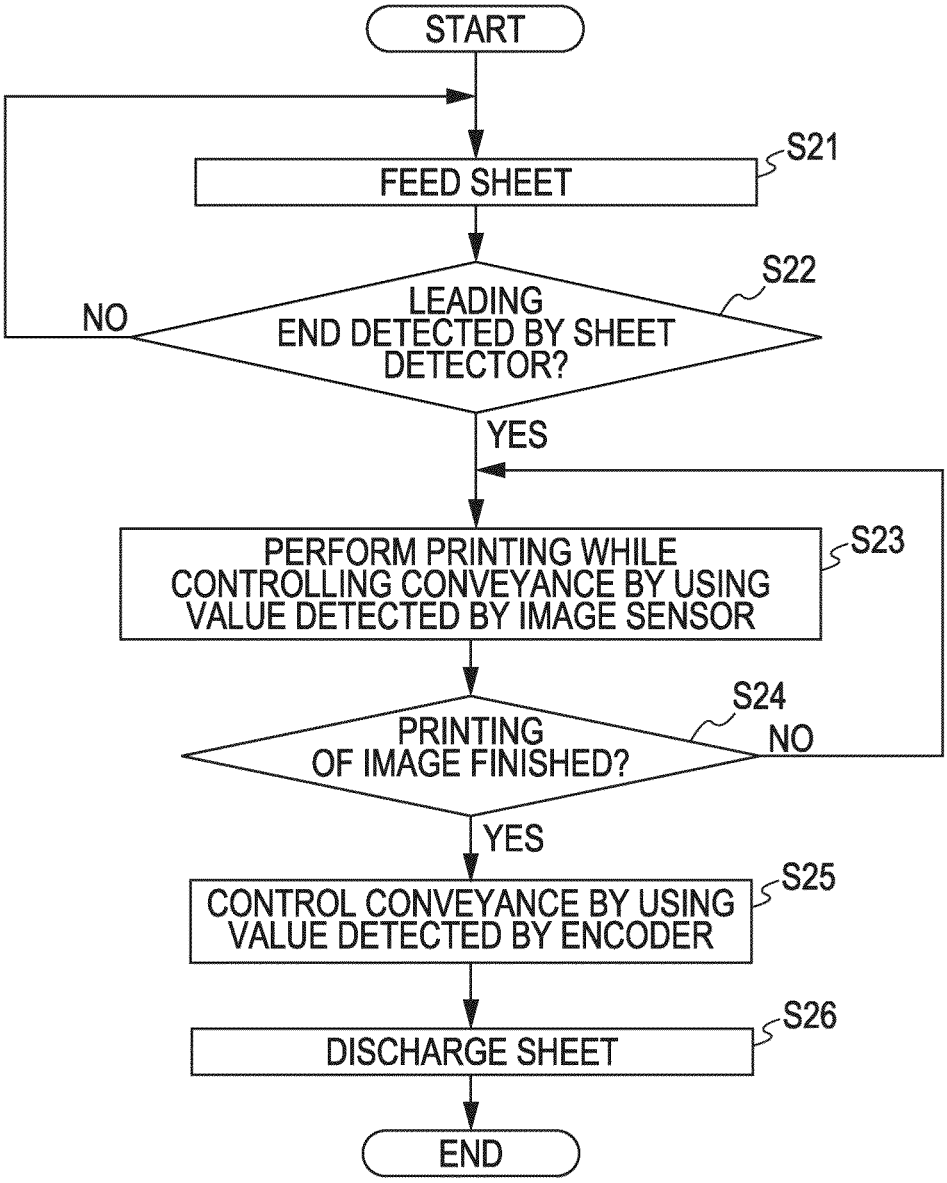
FIG. 11 is a flowchart illustrating the operation sequence of an apparatus.

Referring to the flowchart of FIG. 11, the operation sequence of the printer having the above-described structure will be described. In step S21, a print start command starts feeding of a sheet. In step S22, it is determined whether the leading end of the sheet is detected by the sheet detector 15. Feeding of the sheet is continued until the leading end of the sheet is detected (YES in step S22). When the sheet has correctly reached the conveying unit 20, the conveying roller 21 starts conveying the sheet. In step S23, the conveyance control of the sheet is performed at least on the basis of the detected value obtained by the image sensor 32 and printing is performed. The conveyance control can be performed by using detected values obtained by the image sensor 32 and the encoder. In step S24, the operation of step S23 is repeated until it is determined that image-forming on the sheet has finished (YES). In step S25, the conveyance control of the sheet is performed by using only the detected value obtained by the encoder. In step S26, the sheet is discharged, and the printing operation finishes.

The operation sequence differs from that of the first embodiment in that conveyance control is performed by using the detected value obtained by the image sensor during image-forming. This is because an image of the conveyer belt 40, which more stably moves than the sheet, is taken instead of taking an image of the sheet. Because the surface of the conveyer belt is roughened as described above so as to form microscopic protrusions and recesses, image data can be obtained with an appropriate contrast, whereby detection can be stably performed as compared with the case when an image of the sheet is taken.

With an apparatus according to each of the embodiments described above, the movement of the sheet can be performed by image processing without increasing the cost of the apparatus. Because the sensor unit is embedded in the supporting surface of the platen and the image of the sheet or the belt is taken from the back side of the sheet or the belt, ink mist and dust floating in the apparatus are prevented from adhering to the sensor unit. Therefore, decrease in the detection accuracy is suppressed during a long-time use.

The components of the illumination unit of the sensor unit (the light source and the illumination optical system) and the components of the photodetector (the image sensor substrate and the image-forming optical system) are directly fixed to the platen. Therefore, fluctuation in the optical property of the components can be minimized. Because the sensor unit is disposed directly below the print head, correct movement information at the print position can be obtained.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-092314 filed Apr. 6, 2009, which is hereby incorporated by reference herein in its entirety.

What is claimed is:

1. An apparatus comprising:

a conveying mechanism that conveys a sheet;

a platen that supports the sheet at a processing position; and a sensor unit including an image sensor that takes an image of the sheet so as to detect movement information of the sheet and an illumination unit that has a plurality of light-emitting elements illuminate the sheet, the sensor unit further including a substrate on which the image sensor and the plurality of light emitting elements are mounted, and a transparent cover that covers over the image sensor and the plurality of light emitting elements, wherein the sensor unit is embedded in the platen, the image sensor and the plurality of light emitting elements are disposed in a closed space surrounded by the transparent cover from above and the substrate from below, and the sensor unit takes an image from a back side of the sheet through the transparent cover.

2. The apparatus according to claim 1, wherein the image sensor receives light from the illuminated sheet.

3. The apparatus according to claim 1, wherein the illumination unit includes an illumination guide that guides emitted light toward the sheet, the illumination guide being fixed to the platen.

4. The apparatus according to claim 1, wherein the sensor unit includes an image-forming system that guides light from the sheet toward the image sensor, and wherein the image-forming system is fixed to the platen.

5. The apparatus according to claim 1, further comprising:

a processing unit that processes first image data and second image data so as to obtain movement information of the sheet, the first and second image data having been obtained by taking images of the sheet with the image sensor at different timings while the sheet is being conveyed.

6. The apparatus according to claim 5, further comprising:

a control unit that controls driving of the conveying mechanism based on the obtained movement information.

7. The apparatus according to claim 6, wherein the conveying mechanism includes a pair of rollers that nip and convey the sheet and an encoder that detects rotation of one of the pair of rollers, and wherein the control unit controls driving of the conveying mechanism by using a detection result of the image sensor and a detection result of the encoder.

8. The apparatus according to claim 1, further comprising:

a print processing unit including a print head that performs printing on the sheet that is conveyed, wherein printing is performed on the sheet at the processing position.

9. The apparatus according to claim 8, wherein the sensor unit is disposed directly below the print head with respect to a sub-scanning direction in which the sheet is conveyed.

10. The apparatus according to claim 1, wherein the illumination unit and the image sensor are arranged in a direction intersecting with the conveying direction of the sheet.

11. The apparatus according to claim 1, wherein the image sensor comprises a plurality of sensitive elements arranged in the conveying direction of the sheet.

12. The apparatus according to claim 1, wherein the image sensor further comprises a plurality of sensitive elements arranged in a direction intersecting with the conveying direction of the sheet.

* * * * *